US012359397B2

(12) United States Patent
Shimizu et al.

(10) Patent No.: US 12,359,397 B2
(45) Date of Patent: Jul. 15, 2025

(54) SYSTEM FOR CONTROLLING WORK MACHINE, METHOD, AND WORK MACHINE

(71) Applicant: KOMATSU LTD., Tokyo (JP)

(72) Inventors: Osamu Shimizu, Tokyo (JP); Kei Nakano, Tokyo (JP); Souichi Tsumura, Tokyo (JP)

(73) Assignee: KOMATSU LTD., Tokyo (JP)

( * ) Notice: Subject to any disclaimer, the term of this patent is extended or adjusted under 35 U.S.C. 154(b) by 78 days.

(21) Appl. No.: 18/551,977

(22) PCT Filed: Apr. 19, 2022

(86) PCT No.: PCT/JP2022/018172
§ 371 (c)(1),
(2) Date: Sep. 22, 2023

(87) PCT Pub. No.: WO2022/264683
PCT Pub. Date: Dec. 22, 2022

(65) Prior Publication Data

US 2024/0200304 A1 Jun. 20, 2024

(30) Foreign Application Priority Data

Jun. 17, 2021 (JP) ..... 2021-100723

(51) Int. Cl.
*E02F 3/84* (2006.01)
*E02F 9/26* (2006.01)

(52) U.S. Cl.
CPC ..... *E02F 3/844* (2013.01); *E02F 3/841* (2013.01); *E02F 9/262* (2013.01)

(58) Field of Classification Search
CPC ..... E02F 9/262; E02F 3/841; E02F 3/844
(Continued)

(56) References Cited

U.S. PATENT DOCUMENTS

2018/0355587 A1* 12/2018 Hashimoto ..... E02F 3/844
2019/0078297 A1* 3/2019 Ishibashi ..... G05D 1/0246
(Continued)

FOREIGN PATENT DOCUMENTS

JP 2003-64725 A 3/2003
JP 2019-173470 A 10/2019
(Continued)

OTHER PUBLICATIONS

The International Search Report for the corresponding international application No. PCT/JP2022/018172, issued on Jul. 12, 2022.

*Primary Examiner* — Yazan A Soofi
(74) *Attorney, Agent, or Firm* — Global IP Counselors, LLP

(57) ABSTRACT

A controller acquires a target design surface, at least a portion of which is located above an actual topography. The controller acquires a position of a main body of a work machine. The controller acquires a position of a work implement. The controller causes the work machine to travel forward while controlling the work implement in accordance with the target design surface. The controller acquires a height difference between the target design surface and a predetermined portion of the main body. The controller determines whether there is any more earth held by the work implement based on the height difference.

20 Claims, 16 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2020/0370281 | A1* | 11/2020 | Takaoka | E02F 9/265 |
| 2021/0032841 | A1* | 2/2021 | Ishihara | E02F 3/844 |
| 2022/0049453 | A1* | 2/2022 | Izumi | E02F 9/268 |

FOREIGN PATENT DOCUMENTS

| | | | |
|---|---|---|---|
| JP | 2019-210643 | A | 12/2019 |
| WO | 2018/021341 | A1 | 2/2018 |
| WO | 2018/179384 | A1 | 10/2018 |

* cited by examiner

SYSTEM FOR CONTROLLING WORK MACHINE, METHOD, AND WORK MACHINE

CROSS-REFERENCE TO RELATED APPLICATIONS

This application is a U.S. National stage application of International Application No. PCT/JP2022/018172, filed on Apr. 19, 2022. This U.S. National stage application claims priority under 35 U.S.C. § 119(a) to Japanese Patent Application No. 2021-100723, filed in Japan on Jun. 17, 2021, the entire contents of which are hereby incorporated herein by reference.

TECHNICAL FIELD

The present disclosure relates to a system for controlling a work machine, a method, and a work machine

BACKGROUND INFORMATION

A technique is known that involves automatically controlling a work machine so that a work implement moves according to a target design surface. For example, in Japanese Patent Laid-open No. 2019-173470, a controller determines a target design surface that is positioned below the actual topography. The controller controls the work machine so that the work implement moves according to the target design surface. Consequently, the work machine excavates the actual topography.

SUMMARY

Besides excavation, a work machine performs earth removal work, such as back-filling and embankment work. In the earth removal work, the controller determines a target design surface located above the actual topography and causes the work implement to move according to the target design surface. As a result, earth held by the work implement is disposed along the target design surface on the actual topography. The work machine travels over the earth arranged on the actual topography, thereby compacting the earth.

In the earth removal work, the earth held by the work implement may not be sufficient during the work. In this case, earth cannot be placed on the actual topography even if the work continues. Therefore, in order to improve work efficiency, there is a desire to accurately detect that the earth held by the work implement is insufficient. An object of the present disclosure is to accurately detect that the earth held by the work implement is insufficient in automatic control of a work machine.

A system according to first aspect of the present disclosure is a system for controlling a work machine. The work machine includes a main body including a travel device, and a work implement attached to the main body. The system includes a positional sensor and a controller. The positional sensor detects the position of the work machine. The controller determines a target design surface at least a portion of which is located above an actual topography. The controller acquires the position of the main body. The controller acquires the position of the work implement. The controller causes the work machine to travel forward while controlling the work implement in accordance with the target design surface. The controller acquires the height difference between the target design surface and a predetermined portion of the main body. The controller determines whether there is any more earth held by the work implement based on the height difference.

A method according to a second aspect of the present disclosure is a method for controlling a work machine. The work machine includes a main body including a travel device, and a work implement attached to the main body. The method comprises: acquiring a target design surface at least a portion of which is located above an actual topography; causing the work machine to travel forward while controlling the work implement in accordance with the target design surface; acquiring a height difference between the target design surface and a predetermined portion of the main body; and determining whether there is any more earth held by the work implement based on the height difference.

A work machine according to a third aspect of the present disclosure comprises a main body that includes a travel device, a work implement attached to the main body, a positional sensor that detects the position of the work machine, and a controller. The controller determines a target design surface at least a portion of which is located above an actual topography. The controller acquires the position of the main body. The controller acquires the position of the work implement. The controller causes the work machine to travel forward while controlling the work implement in accordance with the target design surface. The controller acquires the height difference between the target design surface and a predetermined portion of the main body. The controller determines whether there is any more earth held by the work implement based on the height difference.

When there is no more earth held by the work machine during earth removal work, the work machine moves from above being on the removed earth to above the actual topography where no earth is placed. At this time, the height difference of the predetermined portion of the main body with respect to the target design surface changes. According to the present disclosure, the fact that the earth on the work implement is insufficient can be detected accurately based on the height difference between the target design surface and the predetermined portion of the main body.

DESCRIPTION OF EMBODIMENTS

Figure 1:
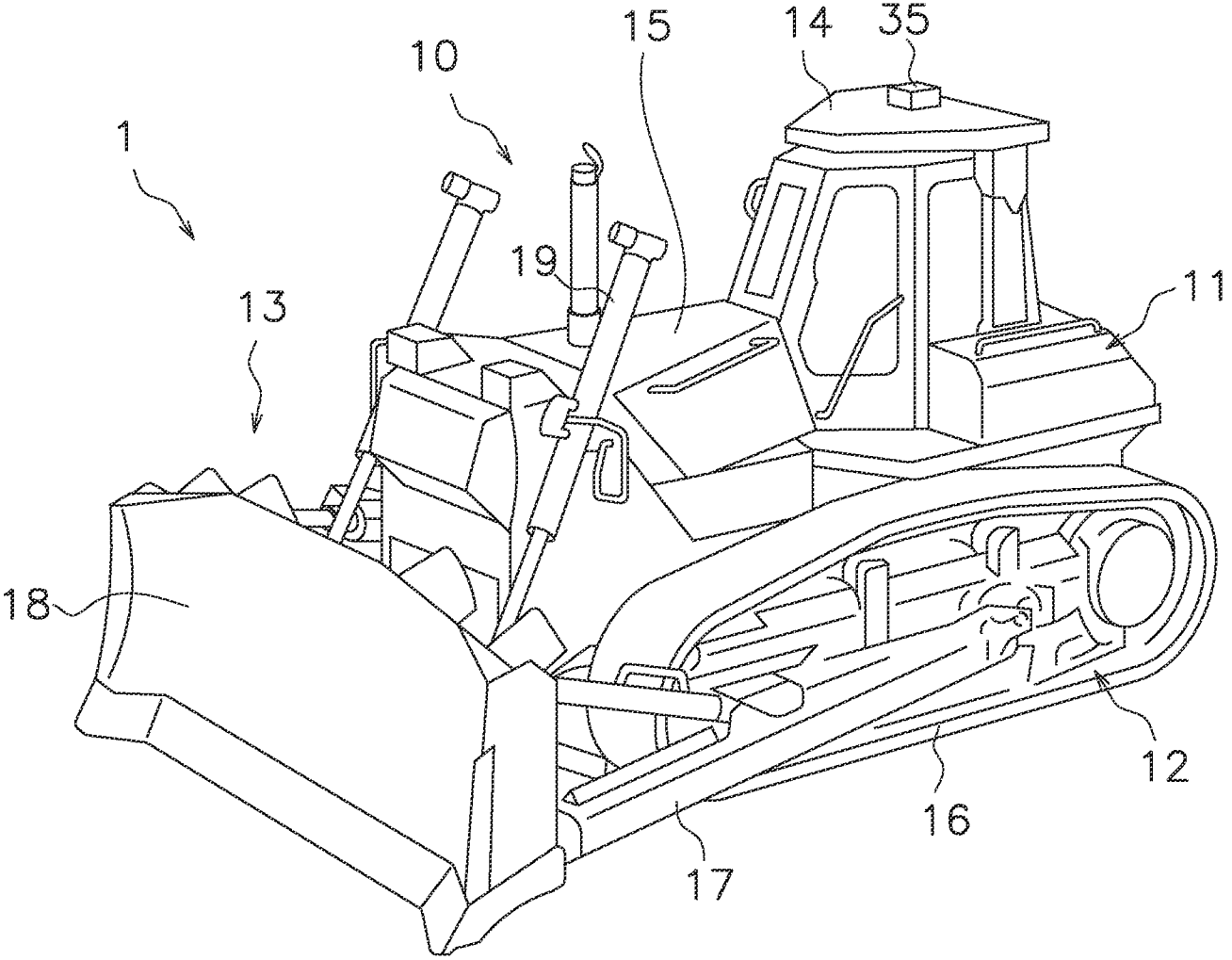
FIG. 1 is a side view of a work machine according to an embodiment.

A work machine according to an embodiment is discussed hereinbelow with reference to the drawings. FIG. 1 is a side view of a work machine 1 according to the embodiment. The work machine 1 according to the present embodiment is a bulldozer. As illustrated in FIG. 1, the work machine 1 includes a main body 10 and a work implement 13.

The main body 10 includes a vehicle body 11 and a travel device 12. The vehicle body 11 includes an operating cabin 14 and an engine compartment 15. An operator's seat that is not illustrated is disposed inside the operating cabin 14. The engine compartment 15 is disposed in front of the operating cabin 14. The travel device 12 is attached to a bottom part of the vehicle body 11. The travel device 12 has a pair of left and right crawler belts 16. Only the crawler belt 16 on the left side is illustrated in FIG. 1. The work machine 1 travels due to the rotation of the crawler belts 16.

Figure 2:
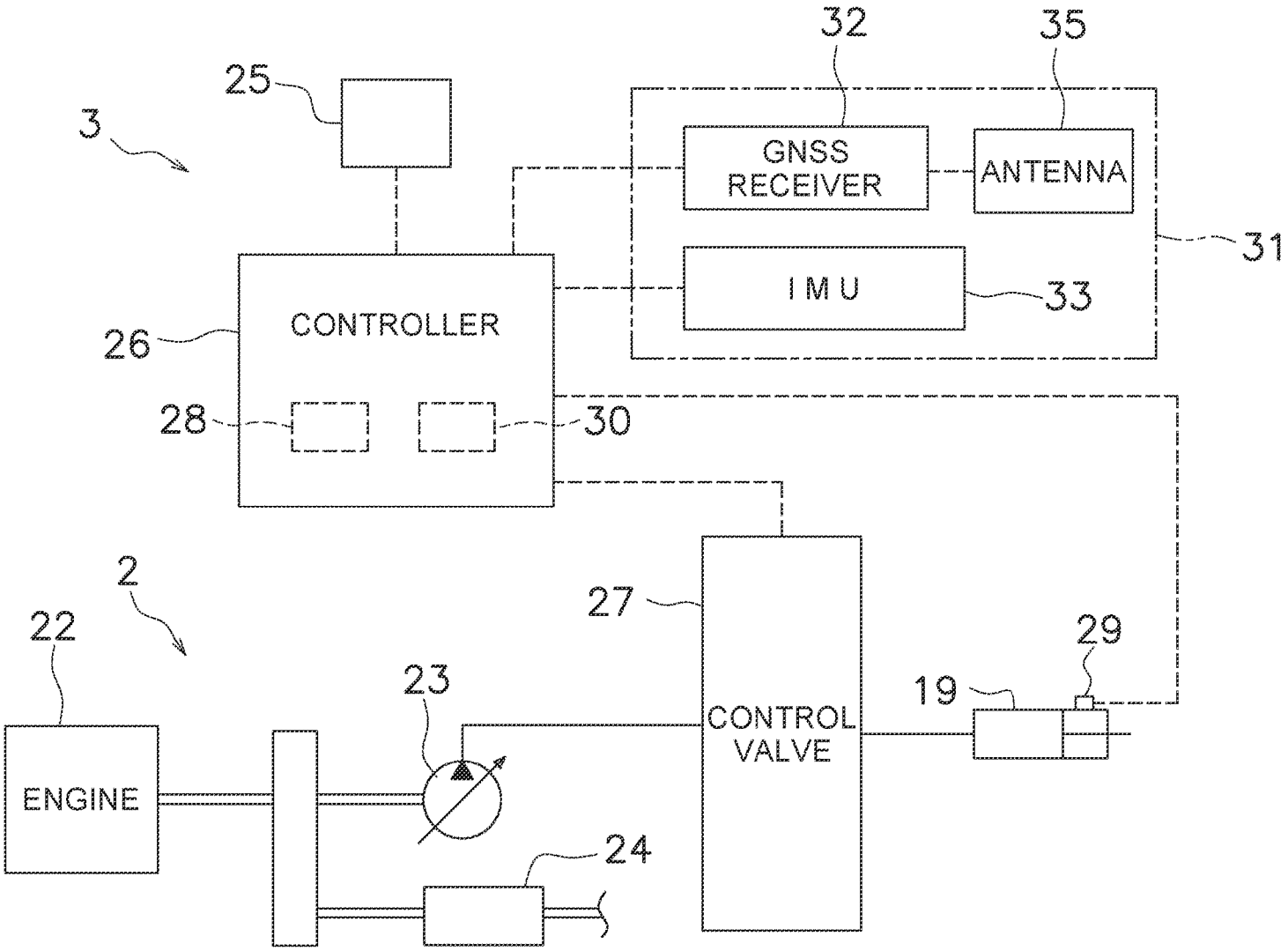
FIG. 2 is a block diagram illustrating a configuration of a drive system and a control system of the work machine.

The work implement 13 is attached to the main body 10. The work implement 13 has a lift frame 17, a blade 18, and a lift cylinder 19. The lift frame 17 is attached to the travel device 12 in a manner that allows movement up and down. The lift frame 17 supports the blade 18. The blade 18 is disposed in front of the vehicle body 11. The blade 18 moves up and down accompanying the up and down movements of the lift frame 17. The lift cylinder 19 is coupled to the vehicle body 11 and the blade 18. Alternatively, the lift cylinder 19 may be coupled to the vehicle body 11 and the lift frame 17. Due to the extension and contraction of the lift cylinder 19, the lift frame 17 moves up and down. The blade 18 is lowered due to the extension of the lift cylinder 19. The blade 18 is raised due to the contraction of the lift cylinder 19, FIG. 2 is a block diagram illustrating a configuration of a drive system 2 and a control system 3 of the work machine 1. As illustrated in FIG. 2, the drive system 2 includes an engine 22, a hydraulic pump 23, and a power transmission device 24. The hydraulic pump 23 is driven by the engine 22 to discharge hydraulic fluid. The hydraulic fluid discharged from the hydraulic pump 23 is supplied to the lift cylinder 19. While only one hydraulic pump is illustrated in FIG. 2, a plurality of hydraulic pumps may be provided.

The power transmission device 24 transmits the driving power of the engine 22 to the travel device 12. The power transmission device 24, for example, may be a hydrostatic transmission (HST). Alternatively, the power transmission device 24 may be, for example, a transmission having a torque converter or a plurality of speed change gears.

The control system 3 includes a controller 26 and a control valve 27. The controller 26 is programmed so as to control the work machine 1 based on acquired data. The controller 26 includes a storage device 28 and a processor 30. The processor 30 includes, for example, a CPU. The storage device 28 includes, for example, a memory and an auxiliary storage device. The storage device 28 may be a RAM or a ROM, for example. The storage device 28 may also be a semiconductor memory or a hard disk and the like. The storage device 28 is an example of a non-transitory computer-readable recording medium. The storage device 28 records computer commands that are executable by the processor and that are for controlling the work machine 1.

The control valve 27 is a proportional control valve and is controlled with command signals from the controller 26. The control valve 27 is disposed between the hydraulic pump 23 and hydraulic actuators such as the lift cylinder 19. The control valve 27 controls the flow rate of the hydraulic fluid supplied from the hydraulic pump 23 to the lift cylinder 19. The controller 26 controls the control valve 27 so as to raise or lower the work implement 13. The control valve 27 may also be a pressure proportional control valve. Alternatively, the control valve 27 may be an electromagnetic proportional control valve.

The control system 3 includes an input device 25. The input device 25 is, for example, a touch panel-type input device. However, the input device 25 also may be an input device such as a switch. An operator uses the input device 25 to input settings for a below mentioned automatic control.

The control system 3 includes a positional sensor 31. The positional sensor 31 measures the position of the work machine 1. The positional sensor 31 includes a global navigation satellite system (GNSS) receiver 32, an IMU 33, and an antenna 35. The GNSS receiver 32 is, for example, a receiver for a global positioning system (GPS). The GNSS receiver 32 receives a positioning signal from a satellite and computes the position of the antenna 35 from the positioning signal. The GNSS receiver 32 generates vehicle body position data that indicates the position of the antenna 35. The controller 26 acquires the vehicle body position data from the GNSS receiver 32.

The IMU 33 is an inertial measurement unit. The IMU 33 acquires vehicle body inclination angle data. The vehicle body inclination angle data includes the angle (pitch angle) relative to horizontal in the vehicle front-back direction and the angle (roll angle) relative to horizontal in the vehicle lateral direction. The controller 26 acquires the vehicle body inclination angle data from the IMU 33.

The control system 3 includes a work implement sensor 29. The work implement sensor 29 detects the attitude of the work implement 13. The attitude of the work implement 13 is, for example, the lift angle of the work implement 13 with respect to the vehicle body 11. For example, the work implement sensor 29 detects the stroke length of the lift cylinder 19. The controller 26 calculates the lift angle of the work implement 13 from the stroke length of the lift cylinder 19. Alternatively, the work implement sensor 29 may be an angle sensor that detects the lift angle of the work implement 13. The work implement sensor 29 generates work implement data that indicates the attitude of the work implement 13. The controller 26 acquires the work implement data from the work implement sensor 29.

Figure 3:
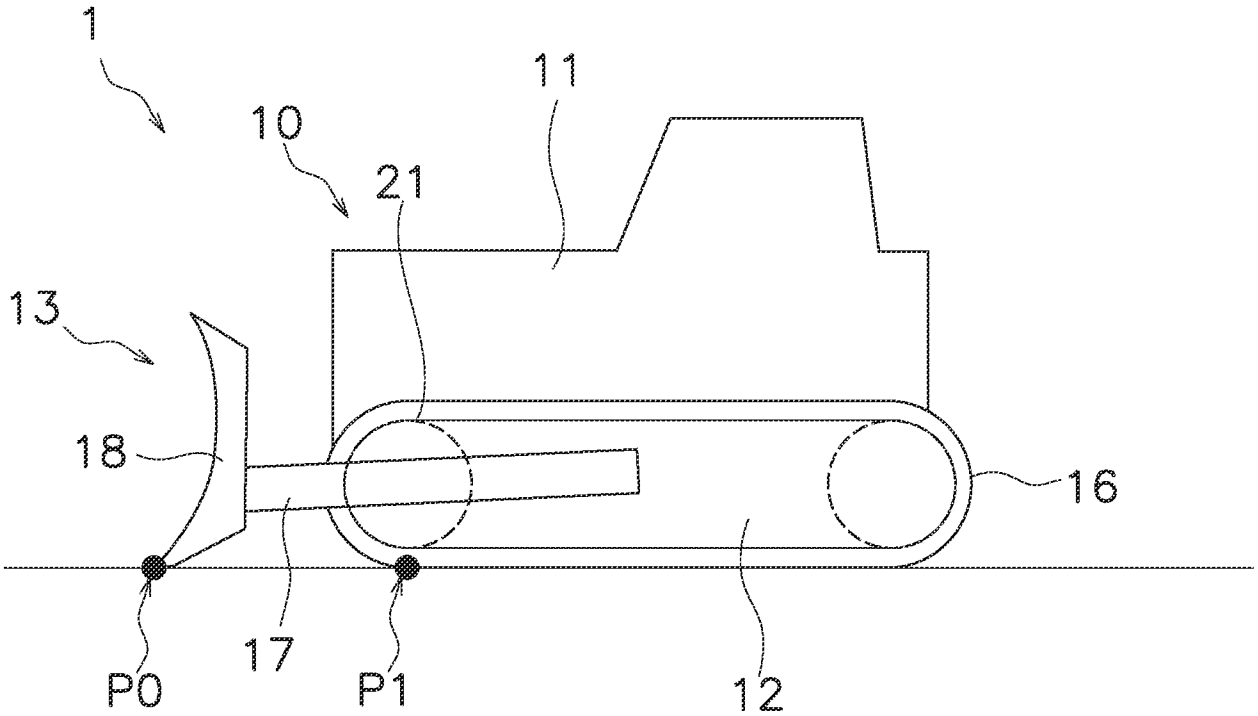
FIG. 3 is a schematic view of a configuration of the work machine.

FIG. 3 is a schematic side view of the work machine 1. The controller 26 stores machine dimension data. The machine dimension data indicates the dimensions and positional relationships of each part of the work machine 1. The controller 26 calculates a blade tip position P0 of the blade 18 from the machine dimension data, the vehicle body position data, the vehicle body inclination angle data, and the work implement data. In addition, the controller 26 computes the position of a predetermined portion P1 of the vehicle body 11 from the machine dimension data, the vehicle body position data, and the vehicle body inclination angle data. The predetermined portion P1 is the position on the bottom surface of the crawler belts 16. The predetermined portion P1 is, for example, located directly below a front idler 21 of the travel device 12. Alternatively, the predetermined portion P1 may be located in the middle in the front-back direction on the bottom surface of the crawler belts 16.

Figure 4:
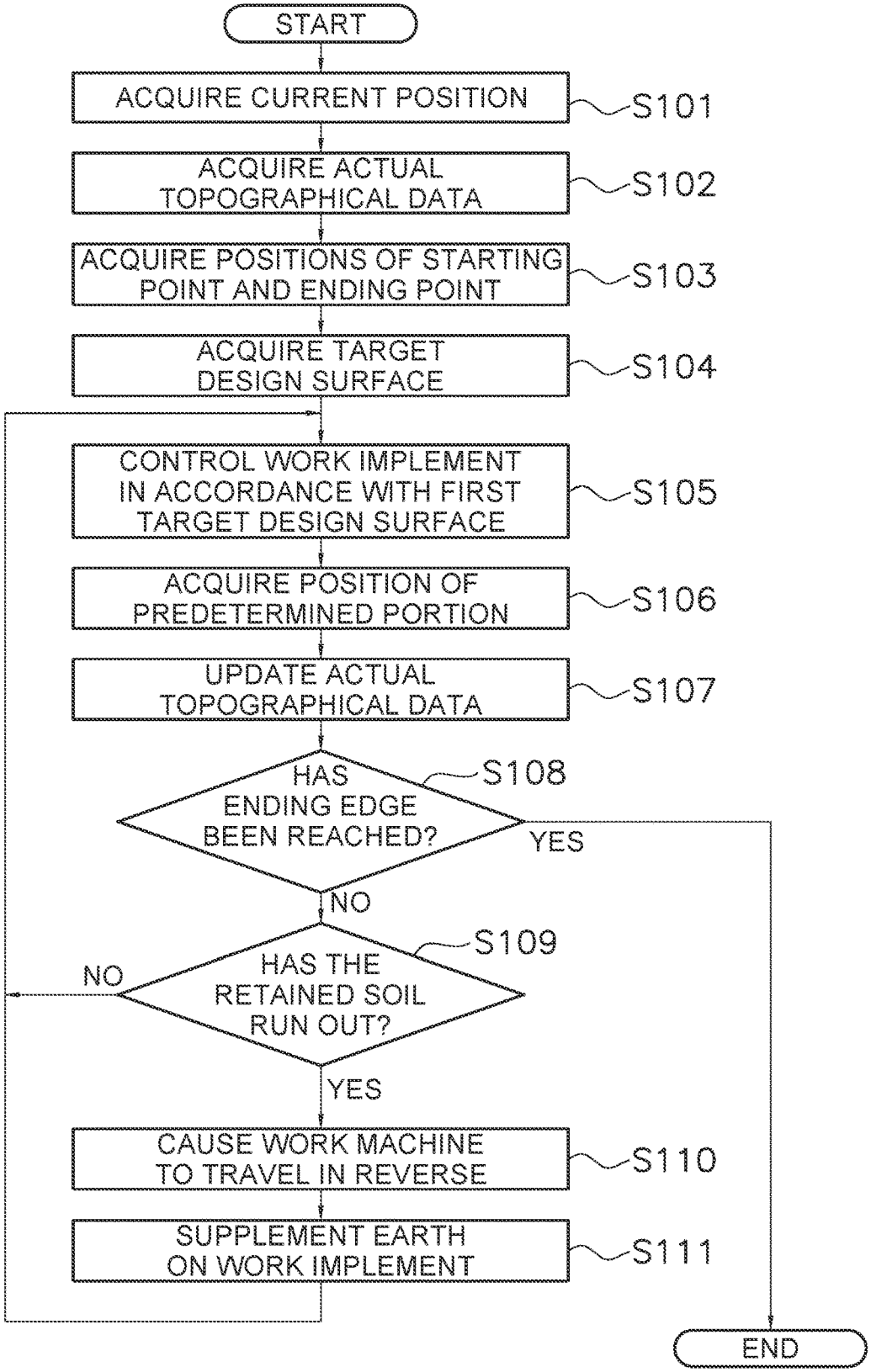
FIG. 4 is a flow chart illustrating an automatic control process of the work machine.

The controller 26 automatically controls the work machine 1. Automatic control of the work machine 1 during back-fill work and executed by the controller 26 will be explained below. FIG. 4 is a flow chart depicting an automatic control process during back-fill work.

In step S101 as illustrated in FIG. 4, the controller 26 acquires the current position of the work machine 1. At this time, the controller 26 acquires the above-mentioned current blade tip position P0 of the blade 18 as the current position of the work machine 1.

Figure 5:
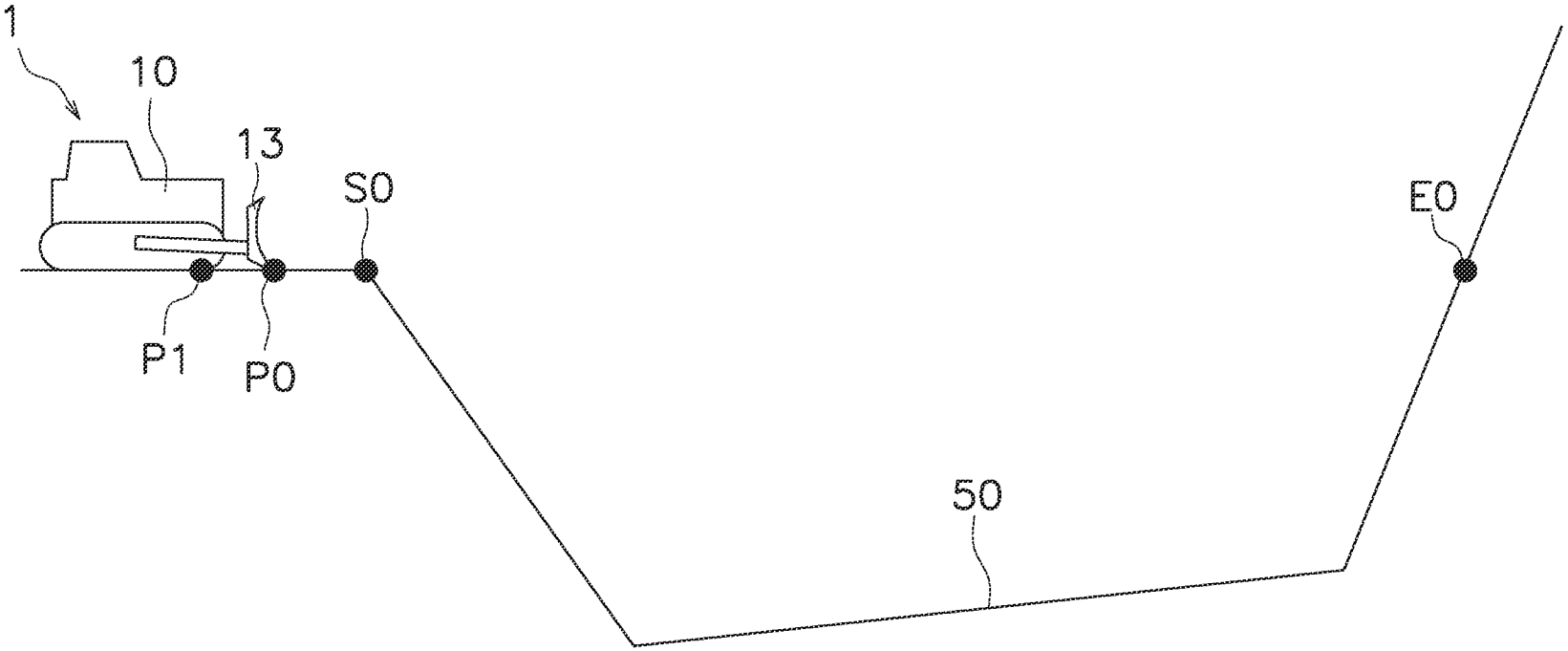
FIG. 5 illustrates an example of an actual topography.

In step S102, the controller 26 acquires the actual topographical data. The actual topographical data represents the actual topography 50 of the work target. FIG. 5 is a side view of an example of the actual topography 50. The actual topographical data includes the heights and coordinates of a plurality of points on the actual topography 50 located in the traveling direction of the work machine 1. The controller 26 may acquire the actual topographical data from an external computer. As described below, the controller 26 may update the actual topographical data from the position of the predetermined portion P1.

In step S103, the controller 26 acquires a starting point S0 and an ending point E0 of the work. The starting point S0 and the ending point E0 of the work are points on the actual topography 50. The ending point E0 is located in front of the starting point S0 in the traveling direction of the work machine 1. The controller 26 may acquire the positions of the starting point S0 and the ending point E0 of the work from an external computer. Alternatively, the controller 26 may acquire the positions of the starting point S0 and the ending point E0 of the work by means of an operation of the input device 25 by the operator.

Figure 6:
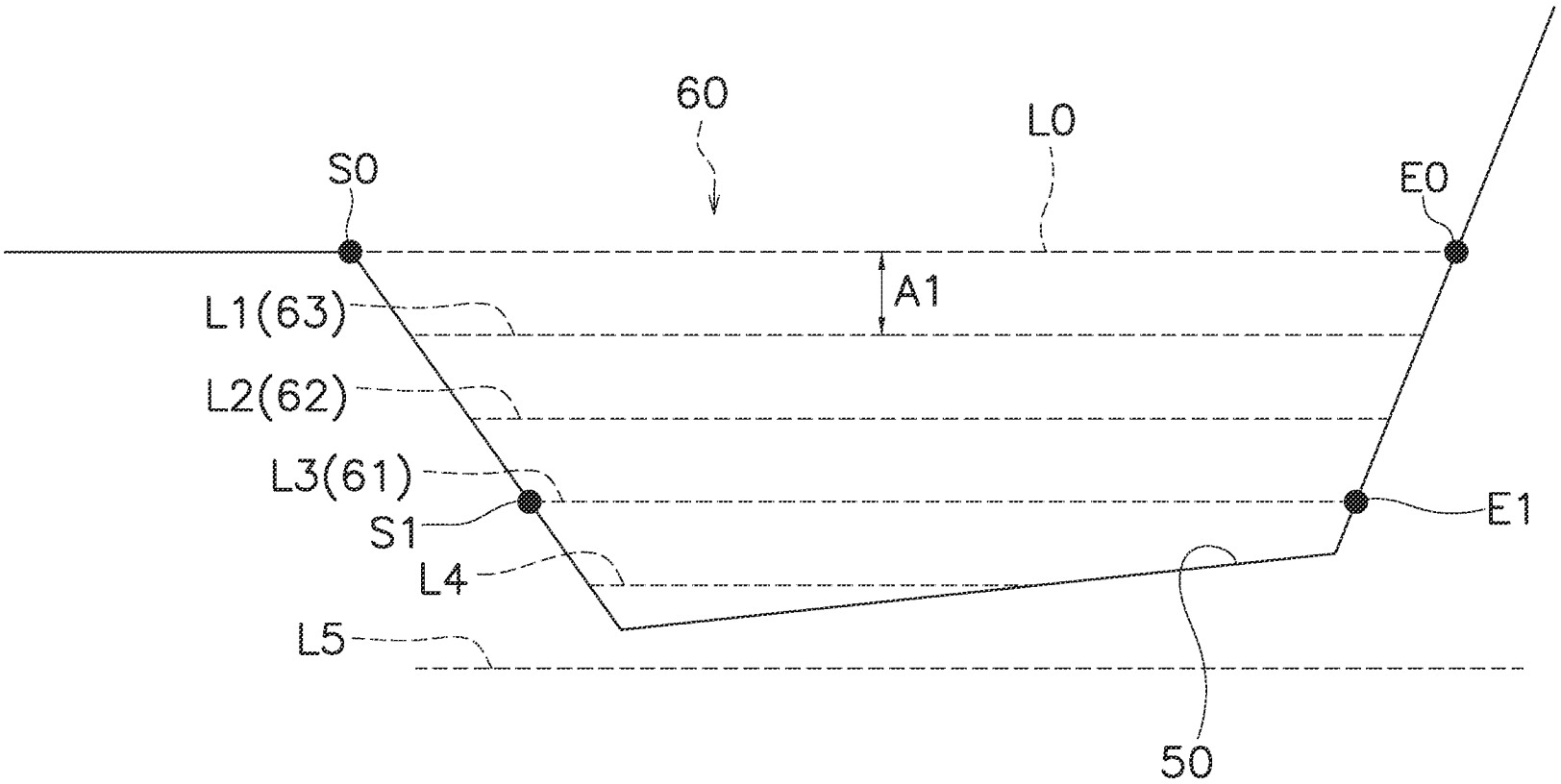
FIG. 6 illustrates an example of a target design surface.

In step S104, the controller 26 acquires the target design surface 60. FIG. 6 illustrates an example of the target design surface 60. At least a portion of the target design surface 60 is located above the actual topography 50. The target design surface 60 is indicated by a line that extends in the front-back direction of the work machine 1, that is, in the traveling direction of the work machine 1. The target design surface 60 is set to be horizontal in the width direction of the work machine 1. The controller 26 determines the target design surface 60 from the positions of the starting point S0 and the ending point E0 of the work and from the actual topography 50. The process for determining the target design surface 60 is explained below.

As illustrated in FIG. 6, the controller 26 determines a reference line L0 that joins the starting point S0 and the ending point E0. The controller 26 determines a plurality of straight lines L1-L5 that are displaced by a predetermined distance A1 downward from the reference line L0. The predetermined distance A1 is stored in the controller 26. The predetermined distance A1 may be a fixed value or may be variable. The controller 26 determines the bottommost straight line L4 among the plurality of straight lines L1-L5 in which at least a portion between the starting point S0 and the ending point E0 is located above the actual topography 50. The controller 26 determines the straight line L3 that is one line above the straight line L4 as a first target design surface 61. The controller 26 may determine the straight line L4 as the first target design surface 61. Alternatively, the controller 26 may determine a straight line that is two or more lines above the straight line L4 as the first target design surface 61.

The controller 26 determines the straight line L2 that is one line above the first target design surface 61 as a second target design surface 62. Similarly, the controller 26 determines the straight line L1 that is one line above the second target design surface 62 as a third target design surface 63. The number of the target design surfaces 60 is not limited to three. However, the number of the target design surfaces 60 may be less than three or more than three.

In step S105, the controller 26 controls the work machine 1 in accordance with the target design surface 60. The target design surface 60 includes a starting edge and an ending edge. The starting edge and the ending edge of the target design surface 60 are both points that the target design surface 60 and the actual topography 50 cross. For example, the first target design surface 61 includes a starting edge S1 and an ending edge E1.

Figure 7:
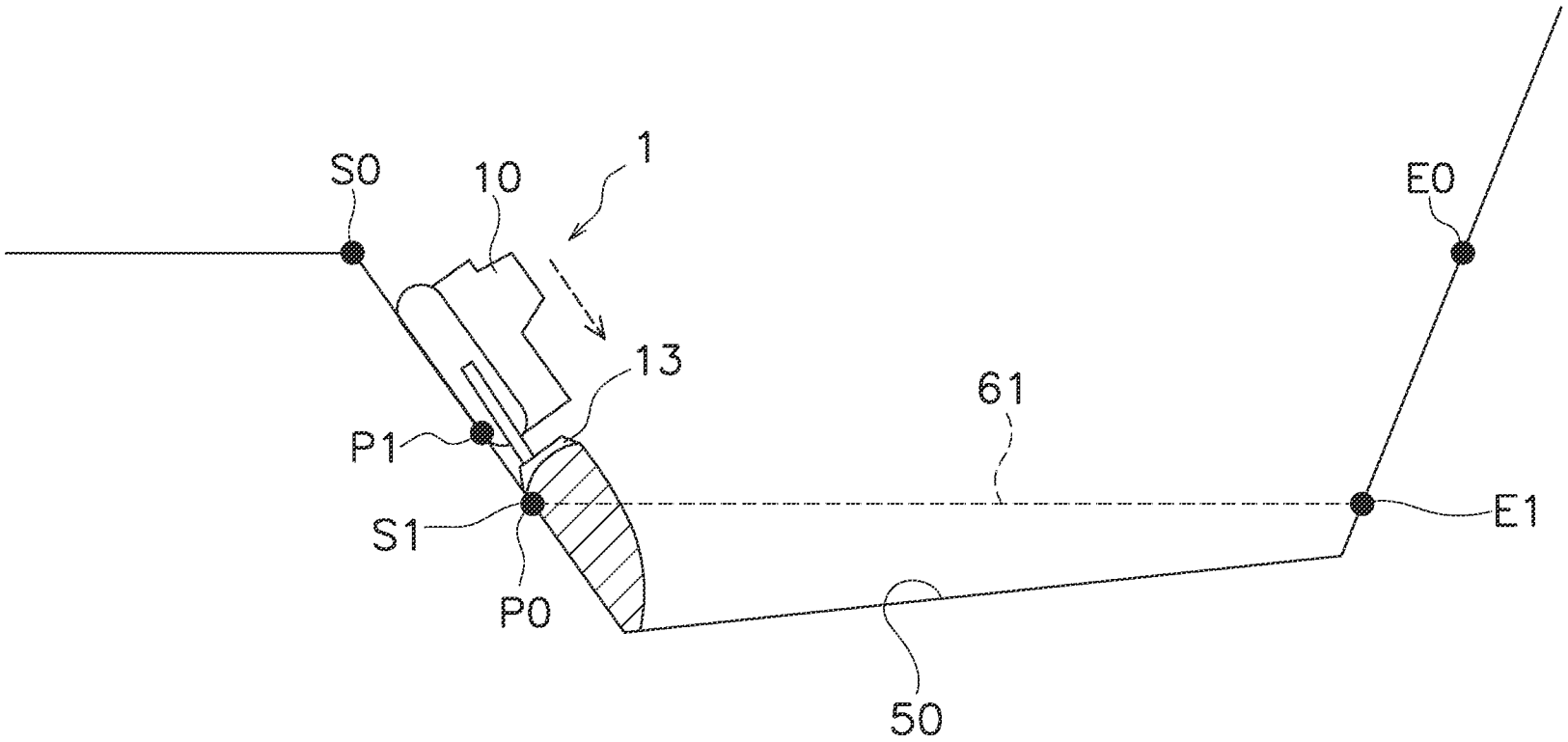
FIG. 7 illustrates a motion of the work machine due to the automatic control.
Figure 8:
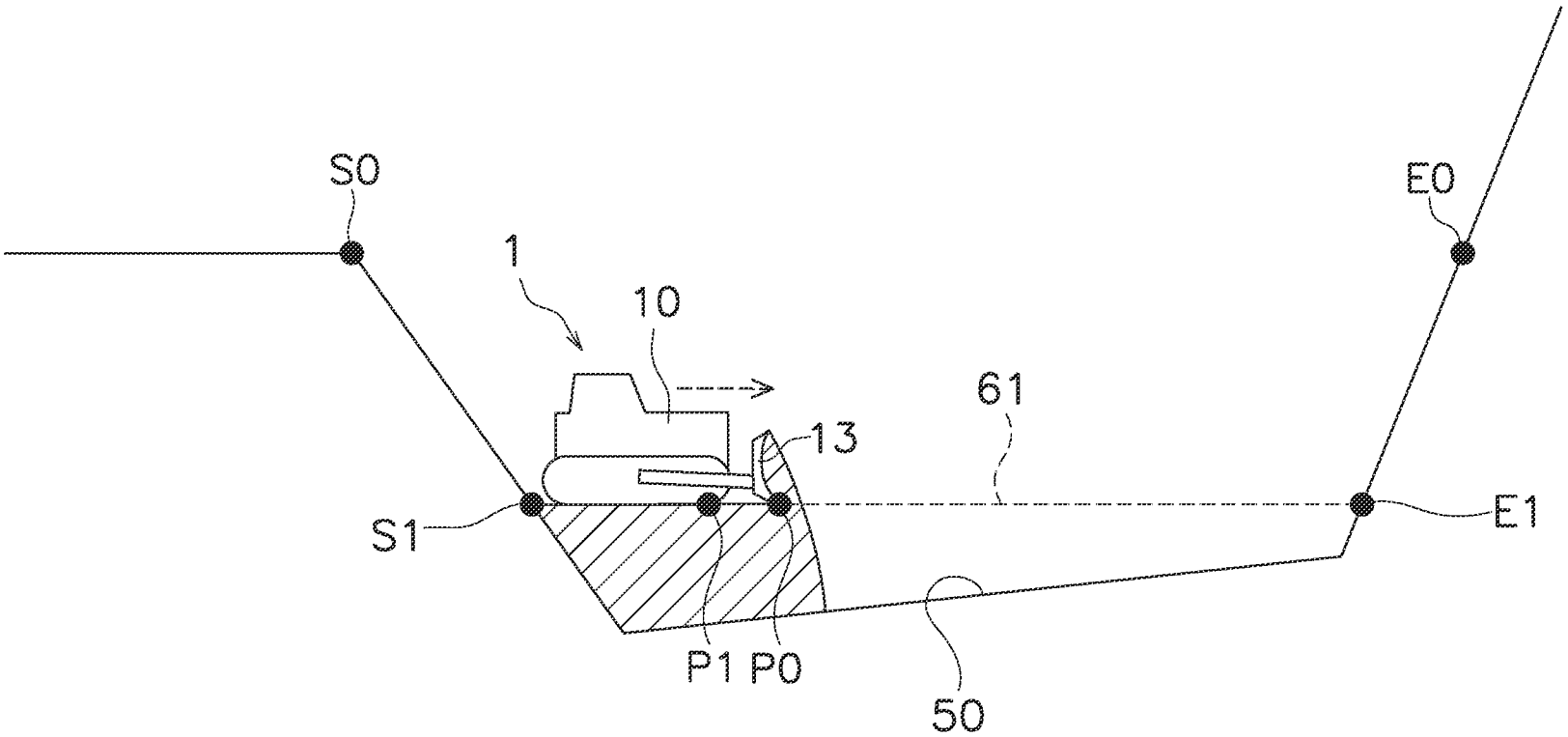
FIG. 8 illustrates a motion of the work machine due to the automatic control.

First, as illustrated in FIG. 7, the controller 26 causes the work machine 1 to travel forward to move to the starting edge S1 of the first target design surface 61 while carrying earth with the work implement 13. Then, as illustrated in FIG. 8, the controller 26 causes the work machine 1 to travel forward while controlling the work implement 13 in accordance with the first target design surface 61. Consequently, earth is disposed on the actual topography 50 along the first target design surface 61. The work machine 1 compacts the earth with the crawler belts 16 by traveling forward over the earth.

In step S106, the controller 26 acquires the position of the predetermined portion P1 of the main body 10. As discussed above, the predetermined portion P1 is the position of the bottom surface of the crawler belts 16. In step S107, the controller 26 updates the actual topographical data. The controller 26 updates the actual topographical data from a locus of the positions of the predetermined portion P1. That is, the locus on which the bottom surface of the crawler belts 16 has moved is used as information that indicates the actual topography 50 after the traveling of the work machine 1, and the actual topographical data is updated.

In step S108, the controller 26 assesses whether the blade tip position P0 has reached the ending edge E1 of the first target design surface 61. When the blade tip position P0 has not reached the ending edge E1 of the first target design surface 61, the process advances to step S109.

Figure 9:
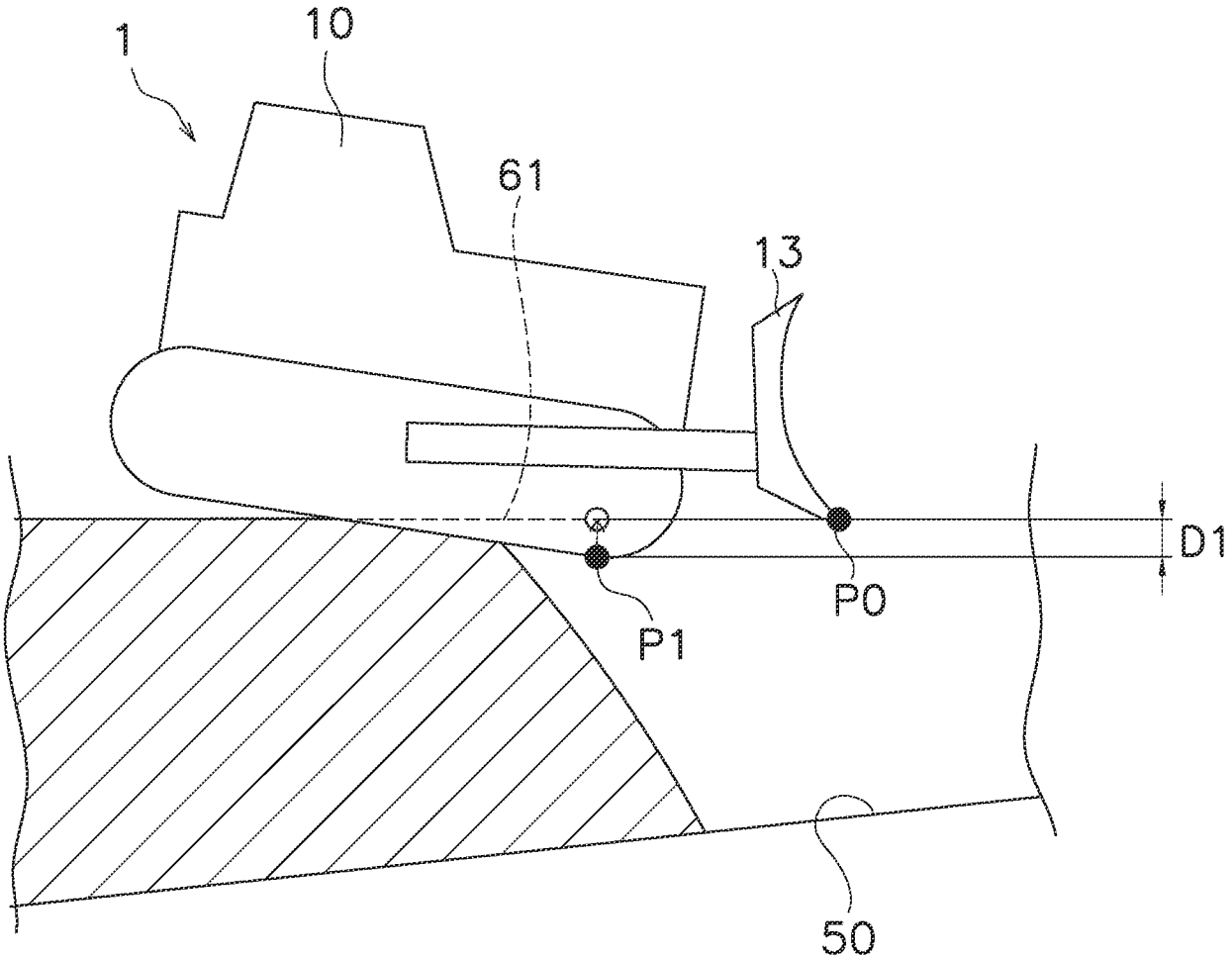
FIG. 9 illustrates a motion of the work machine due to the automatic control.

In step S109, the controller 26 assesses whether there is any more earth held by the work implement 13. The controller 26 calculates a height difference D1 between the first target design surface 61 and the predetermined portion P1. As illustrated in FIG. 9, the height difference D1 is the distance in the height direction between the first target design surface 61 and the predetermined portion P1. The height direction is, for example, the vertical direction. However, the height direction may be a direction perpendicular to the first target design surface 61.

The controller 26 assesses whether the height difference D1 is equal to or greater than a threshold. The threshold may be a fixed value. Alternatively, the threshold may be variable. The threshold may be decided in consideration of the height of the earth compressed by means of the crawler belts 16. As illustrated in FIG. 9, when there is no more earth held by the work implement 13, the work machine 1 travels forward and crosses the compacted earth, thereby increasing the height difference D1 between the first target design surface 61 and the predetermined portion P1 of the main body 10. Therefore, the controller 26 assesses whether there is any more earth held by the work implement by assessing whether the height difference D1 is equal to or greater than the threshold.

When there is remaining earth held by the work implement 13, the process returns to step S105. Consequently, the controller 26 continues to cause the work machine 1 to travel forward while controlling the work implement 13 in accordance with the first target design surface 61. When the height difference D1 equals or exceeds the threshold, the process advances to step S110.

Figure 10:
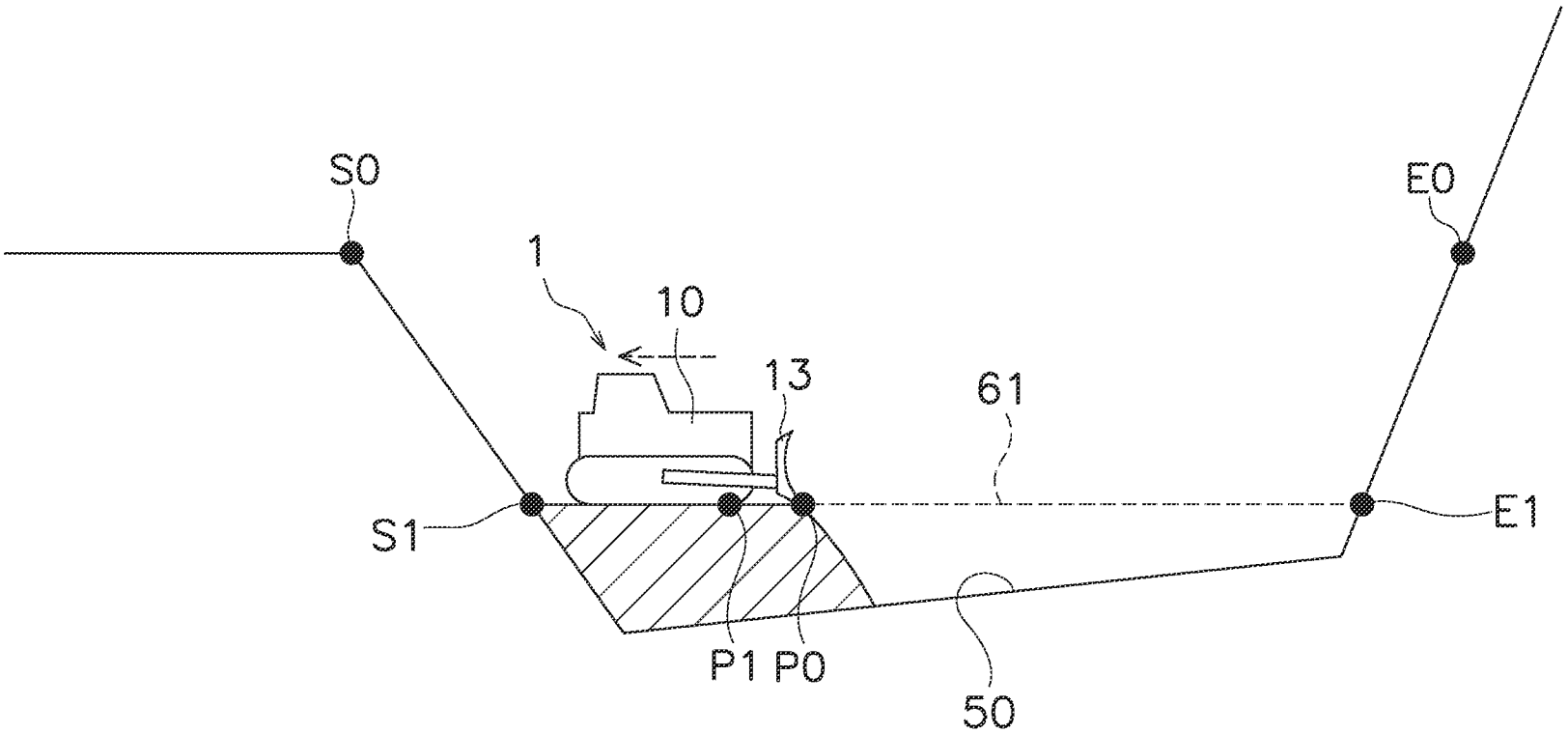
FIG. 10 illustrates a motion of the work machine due to the automatic control.

In step S110, the controller 26 causes the work machine 1 to travel in reverse. As illustrated in FIG. 10, after the work machine 1 has stopped traveling forward, the work machine 1 travels in reverse. In step S111, the controller 26 supplements the earth on the work implement 13. Thereafter, the process advances to step S105. Consequently, the controller 26 continues to cause the work machine 1 to travel forward while controlling the work implement 13 in accordance with the first target design surface 61.

Figure 11:
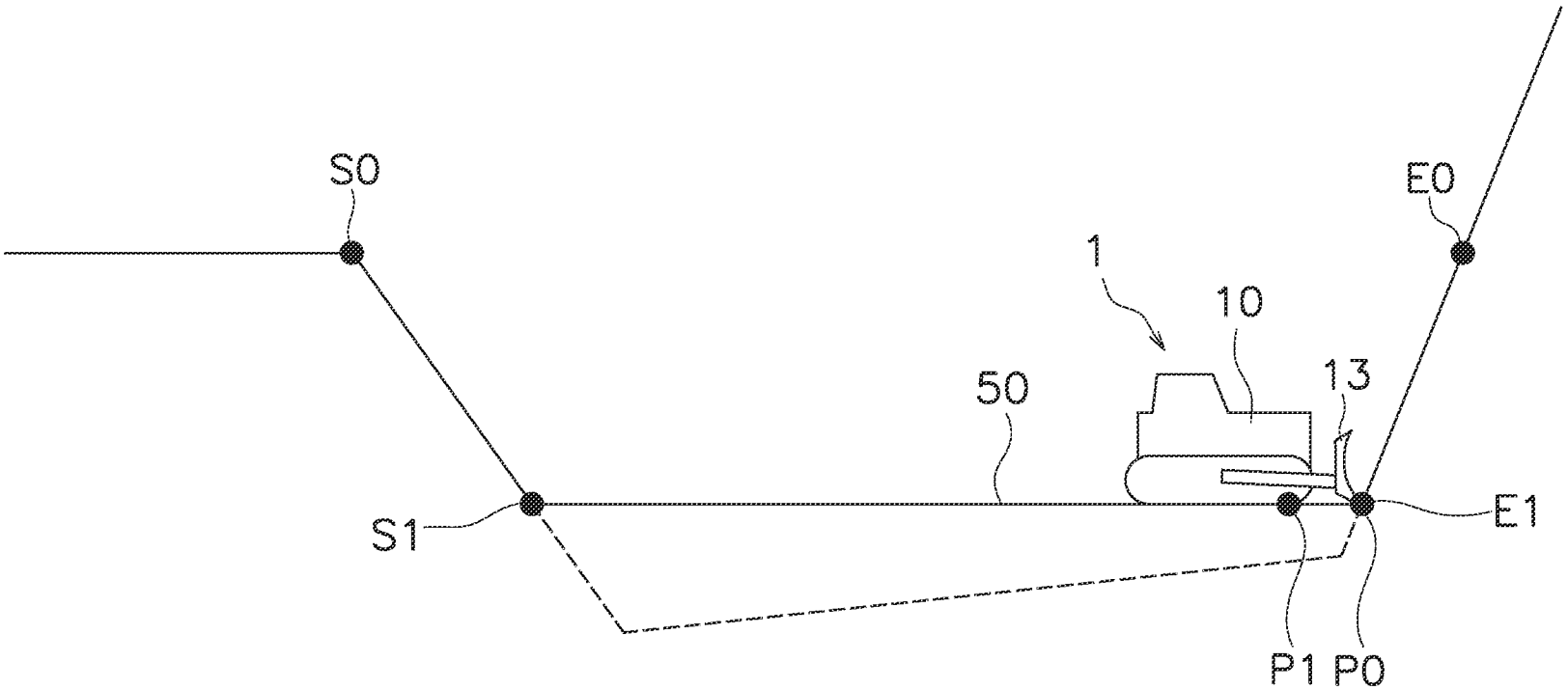
FIG. 11 illustrates a motion of the work machine due to the automatic control.

In step S108, as illustrated in FIG. 11, when the blade tip position P0 reaches the ending edge E1 of the first target design surface 61, the controller 26 ends the work in accordance with the first target design surface 61. The controller 26 then performs the same process as discussed above on the second target design surface 62. When the work following the second target design surface 62 is finished, the controller 26 performs the same process as discussed above on the third target design surface 63.

In the control system 3 according to the present embodiment discussed above, whether there is any more earth held by the work implement 13 is assessed based on the height difference D1 between the target design surface 60 and the predetermined portion P1 of the main body 10. Consequently, the fact that there is no more earth held by the work implement 13 can be easily and accurately detected. Specifically, in the control system 3 according to the present embodiment, the fact that there is no more earth held by the work implement 13 is estimated. When the work machine 1 is a bulldozer, whether there is any more earth carried by the blade 18 is estimated by the control system 3 according to the present embodiment.

Although an embodiment of the present invention has been described so far, the present invention is not limited to the above embodiment and various modifications may be made within the scope of the invention.

The work machine 1 is not limited to a bulldozer, and may be another type of machine, such as a wheel loader or a motor grader and the like. The input device 25 may be disposed outside of the work machine 1. The work machine 1 may be a manned machine in which an operator sits or may be an unmanned machine that no operator sits in. The operating cabin may be omitted from the work machine 1.

Figure 12:
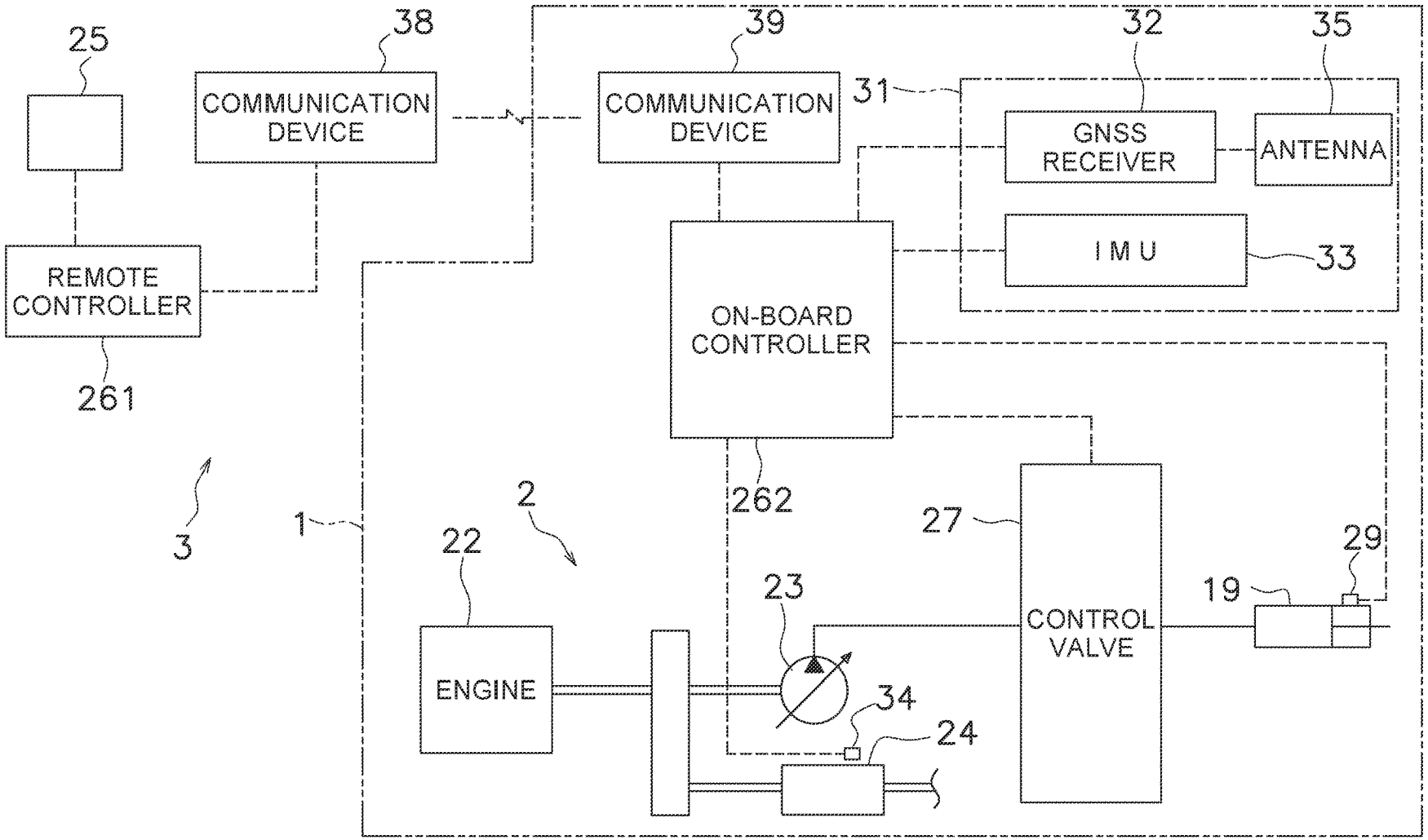
FIG. 12 is a block diagram of a configuration of a drive system and the control system of the work machine according to a modified example.

The controller 26 may have a plurality of controllers separate from each other. For example as illustrated in FIG. 12, the controller 26 may include a remote controller 261 disposed outside of the work machine and an on-board controller 262 mounted on the work machine. The remote controller 261 and the on-board controller 262 may be able to communicate wirelessly through communication devices 38 and 39. A portion of the functions of the above-mentioned controller 26 may be executed by the remote controller 261 and the remaining functions may be executed by the on-board controller 262. For example, the process for determining the target design surface 60 may be performed by the remote controller 261, and the process for outputting the command signals to the work implement 13 may be performed by the on-board controller 262.

The processes performed by the controller 26 are not limited to those of the above embodiment and may be changed. A portion of the above-mentioned processes may be omitted. A portion of the above-mentioned processes may be changed. For example, the process for assessing whether there is any more earth held by the work implement 13 is not limited to the above embodiment and may be changed.

Figure 13:
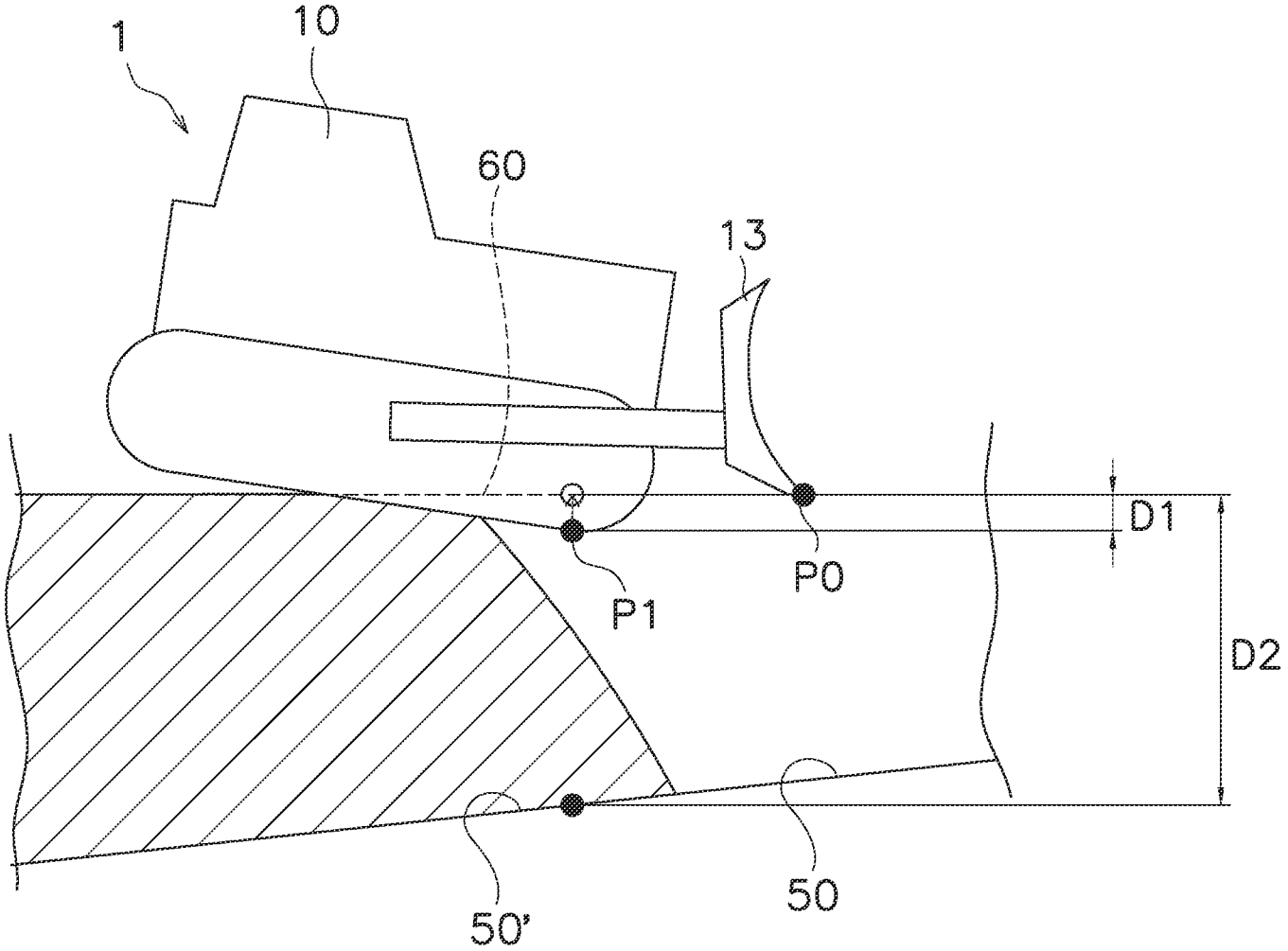
FIG. 13 illustrates an assessment process according to a modified example.

FIG. 13 illustrates an assessment process according to a modified example. As illustrated in FIG. 13, the height difference between the target design surface 60 and the predetermined portion P1 may be calculated as a first height difference D1. The controller 26 may calculate the height difference between the target design surface 60 and the actual topography 50' before the traveling of the work machine 1, as a second height difference D2. The controller 26 may assess that there is no more earth held by the work implement 13 when a ratio (D1/D2) of the first height difference D1 with respect to the second height difference D2 is equal to or greater than a threshold.

The controller 26 may assess that there is no more earth held by the work implement 13 when the fact that the height difference D1 between the target design surface 60 and the position of the predetermined portion P1 being equal to or greater than the threshold continues for a predetermined time period. The controller 26 may assess that there is no more earth held by the work implement 13 when the fact that ratio of the first height difference D1 with respect to the second height difference D2 is equal to or greater than a threshold continues for a predetermined time period.

Figure 14:
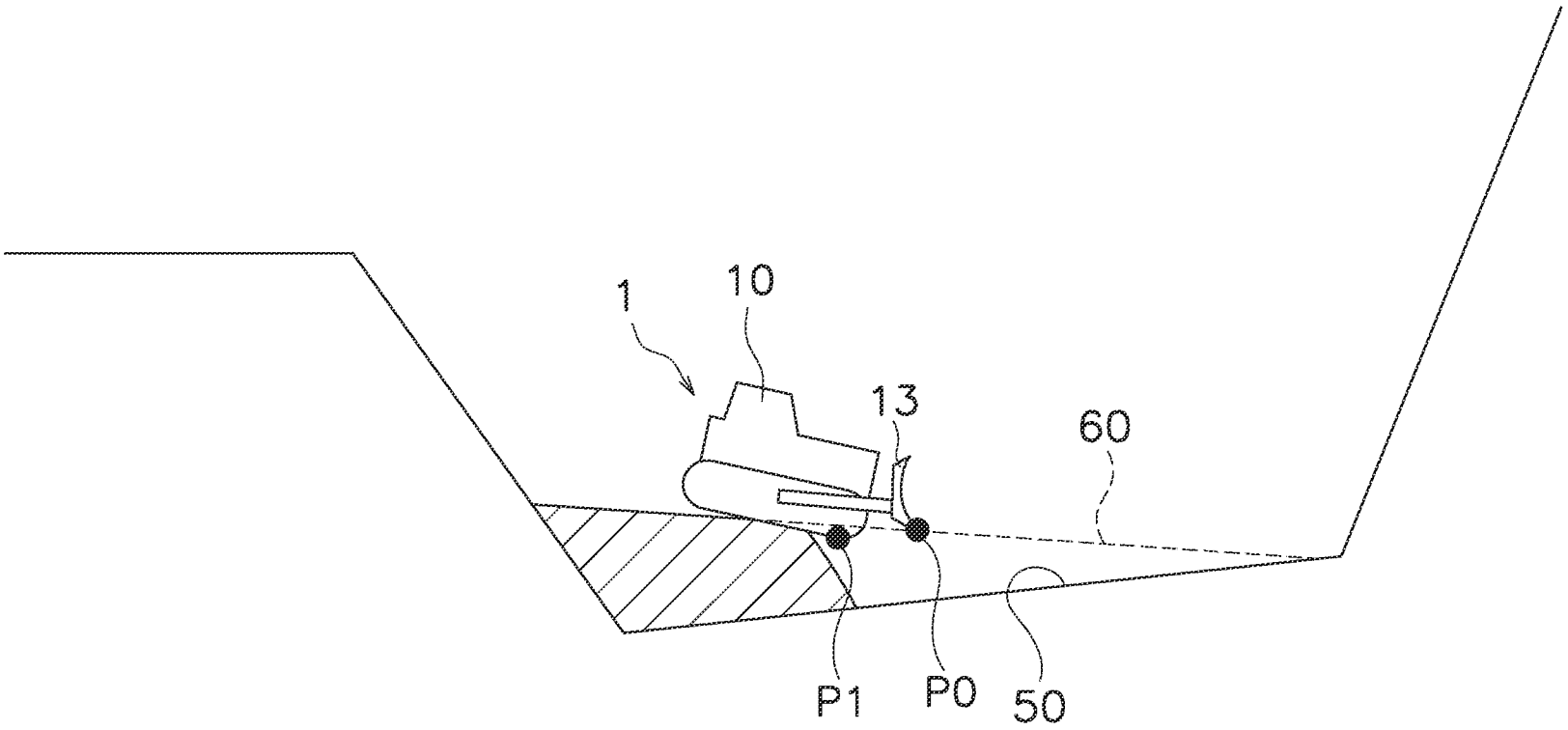
FIG. 14 illustrates an example of a target design surface according to a first modified example.
Figure 15:
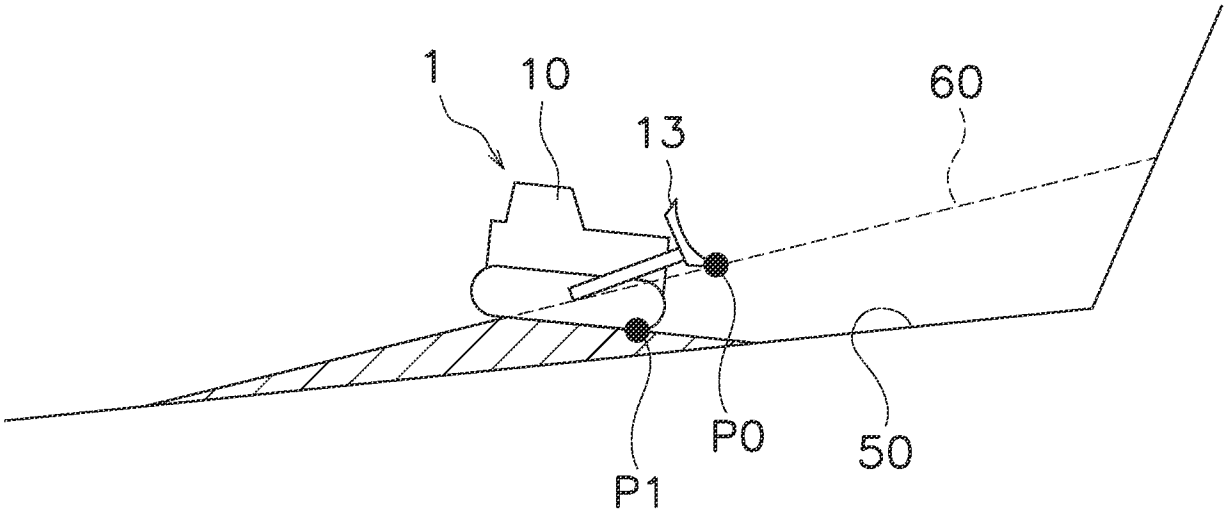
FIG. 15 illustrates an example of a target design surface according to a second modified example.

The shape of the target design surface 60 is not limited to the above embodiment and may be modified. The target design surface 60 is not limited to horizontal and may be slanted with respect to the horizontal direction. For example, FIG. 14 illustrates the target design surface 60 according to a first modified example. As illustrated in FIG. 14, the target design surface 60 may be slanted downward. FIG. 15 illustrates the target design surface 60 according to a second modified example. As illustrated in FIG. 15, the target design surface 60 may be slanted upward.

Figure 16:
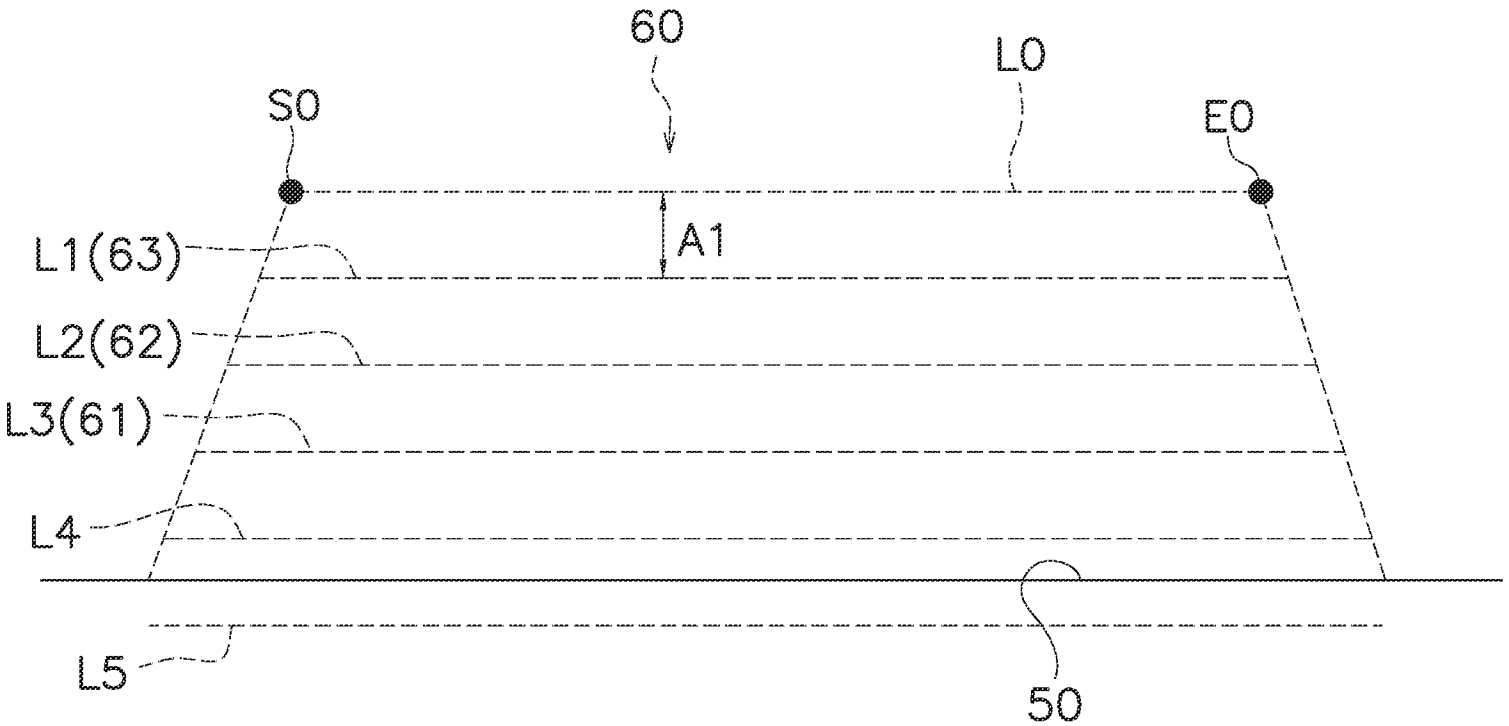
FIG. 16 illustrates an example of a target design surface according to a third modified example.

The work performed by the work machine 1 is not limited to back-filling and may be other work, such as embankment work. For example, FIG. 16 illustrates the target design surface 60 according to a third modified example. In FIG. 16, the same reference symbols are applied to the configurations corresponding to those of FIG. 6. As illustrated in FIG. 16, in the embankment work, the starting point S0 and the ending point E0 of the work may be positioned above the actual topography 50. The process for determining the target design surface 60 is the same as the above embodiment.

The predetermined portion P1 is not limited to the bottom surface of the crawler belts 16 and may be another portion. For example, the predetermined portion P1 may be another portion of the travel device 12. Alternatively, the predetermined portion P1 may be a portion of the vehicle body 11.

According to the present disclosure, the fact that the earth on the work implement is insufficient can be detected accurately.

What is claimed is:

1. A system for controlling a work machine including a main body including a travel device, and a work implement attached to the main body, the system comprising:

a positional sensor configured to detect a position of the work machine, and a controller configured to acquire a target design surface, at least a portion of the target design surface being located above an actual topography, acquire the position of the main body, acquire a position of the work implement, cause the work machine to travel forward while controlling the work implement in accordance with the target design surface, acquire a height difference between the target design surface and a predetermined portion of the main body, and determine, based on the height difference, whether there is any more earth held by the work implement.

2. The system according to claim 1, wherein the predetermined portion is included in the travel device.

3. The system according to claim 1, wherein the travel device includes a crawler belt, and the predetermined portion is included on the crawler belt.

4. The system according to claim 1, wherein the controller is further configured to cause the work machine to stop traveling forward and cause the work machine to travel in reverse upon assessing that there is no more earth held by the work implement.

5. The system according to claim 1, wherein the controller is further configured to acquire a starting point and an ending point for earth removal work, determine a reference line that joins the starting point and the ending point, and determine, as the target design surface, a line in which the reference line is displaced a predetermined distance in a height direction.

6. The system according to claim 1, wherein the controller is further configured to acquire a starting point and an ending point for earth removal work, determine a reference line that joins the starting point and the ending point, determine a plurality of straight lines in which the reference line is displaced by respective predetermined distances downward, and determine, as the target design surface, a straight line, among the plurality of straight lines, equal to or higher than a bottommost straight line, at least a portion of the straight line between the starting point and the ending point being positioned above the actual topography.

7. The work machine according to claim 6, wherein the controller is further configured to determine, as a first target design surface, at least one straight line, among the plurality of straight lines, higher than the bottommost straight line, at least a portion of the at least one straight line between the starting point and the ending point being positioned above the actual topography.

8. The system according to claim 7, wherein the controller is further configured to determine a straight line one above the first target design surface among the plurality of straight lines as a second target design surface, cause the work machine to travel forward while controlling the work implement in accordance with the first target design surface, and cause the work machine to travel forward while controlling the work implement in accordance with the second target design surface after the work on the first target design surface.

9. The system according to claim 1, wherein the controller is further configured to assess that there is no more earth held by the work implement when the height difference is equal to or greater than a threshold.

10. The system according to claim 1, wherein the controller is further configured to acquire as a first height difference, the height difference between the target design surface and the predetermined portion, acquire, as a second height difference, a height difference between the target design surface and the actual topography before the traveling of the work machine, and assess that there is no more earth held by the work implement when a ratio of the first height difference with respect to the second height difference is equal to or greater than a threshold.

11. A method for controlling a work machine including a main body including a travel device, and a work implement attached to the main body, the method comprising:

acquiring a target design surface, at least a portion of the target design surface being located above an actual topography, acquiring a position of the main body, acquiring a position of the work implement, causing the work machine to travel forward while controlling the work implement in accordance with the target design surface, acquiring a height difference between the target design surface and a predetermined portion of the main body, and determining whether there is any more earth held by the work implement based on the height difference.

12. The method according to claim 11, wherein the predetermined portion is included in the travel device.

13. The method according to claim 11, wherein the travel device includes a crawler belt, and the predetermined portion is included on the crawler belt.

14. The method according to claim 11, further comprising causing the work machine to stop traveling forward and causing the work machine to travel in reverse upon assessing that there is no more earth held by the work implement.

15. The method according to claim 11, further comprising acquiring a starting point and an ending point for earth removal work;

determining a reference line that joins the starting point and the ending point; and determining, as the target design surface, a line in which the reference line is displaced by a predetermined distance in a height direction.

16. The method according to claim 11, further comprising acquiring a starting point and an ending point for earth removal work;

determining a reference line that joins the starting point and the ending point;

determining a plurality of straight lines in which the reference line is displaced downward by respective predetermined distances; and determining, as the target design surface, a straight line, among the plurality of straight lines, equal to or higher than a bottommost straight line, at least a portion of the straight line between the starting point and the ending point being positioned above the actual topography.

17. The method according to claim 16, further comprising determining, as a first target design surface, at least one straight line, among the plurality of straight lines, higher than the bottommost straight line, at least a portion of the at least one straight line between the starting point and the ending point is positioned above the actual topography.

18. The method according to claim 11, further comprising assessing that there is no more earth held by the work implement when the height difference is equal to or greater than a threshold.

19. The method according to claim 11, further comprising acquiring, as a first height difference, the height difference between the target design surface and the predetermined portion;

acquiring, as a second height difference, a height difference between the target design surface and the actual topography before the traveling of the work machine; and assessing that there is no more earth held by the work implement when a ratio of the first height difference with respect to the second height difference is equal to or greater than a threshold.

20. A work machine comprising:

a main body including a travel device;

a work implement attached to the main body;

a positional sensor configured to detect a position of the work machine; and a controller configured to determine a target design surface, at least a portion of the target design surface being located above an actual topography, acquire the position of the main body, acquire a position of the work implement and cause the work machine to travel forward while controlling the work implement in accordance with the target design surface, acquire a height difference between the target design surface and a predetermined portion of the main body, and determine whether there is any more earth held by the work implement based on the height difference.

* * * * *